US008574053B1

(12) United States Patent
Nelson et al.

(10) Patent No.: US 8,574,053 B1
(45) Date of Patent: Nov. 5, 2013

(54) MULTIPLE STOP INDICATOR BONUS GAME

(75) Inventors: Loren Nelson, Reno, NV (US); Dean Kawada, Reno, NV (US); Jesse Ruppert, Reno, NV (US); Dayan Paul, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 2188 days.

(21) Appl. No.: 11/233,950

(22) Filed: Sep. 22, 2005

Related U.S. Application Data

(60) Provisional application No. 60/616,582, filed on Oct. 5, 2004.

(51) Int. Cl.
*A63F 9/24* (2006.01)

(52) U.S. Cl.
USPC ..... 463/16

(58) Field of Classification Search
USPC ..... 463/20, 16, 25
See application file for complete search history.

(56) References Cited

U.S. PATENT DOCUMENTS

| | | | | | |
|---|---|---|---|---|---|
| 6,159,097 | A * | 12/2000 | Gura | ..... | 463/20 |
| 6,159,098 | A * | 12/2000 | Slomiany et al. | ..... | 463/25 |
| 6,190,255 | B1 * | 2/2001 | Thomas et al. | ..... | 463/20 |
| 6,439,995 | B1 * | 8/2002 | Hughs-Baird et al. | ..... | 463/20 |
| 6,595,854 | B2 * | 7/2003 | Hughs-Baird et al. | ..... | 463/20 |
| 6,632,139 | B1 * | 10/2003 | Baerlocher | ..... | 463/16 |
| 6,645,074 | B2 * | 11/2003 | Thomas et al. | ..... | 463/20 |
| 6,648,757 | B1 * | 11/2003 | Slomiany et al. | ..... | 463/20 |
| 6,843,722 | B2 * | 1/2005 | Webb | ..... | 463/16 |
| 6,905,412 | B2 * | 6/2005 | Thomas et al. | ..... | 463/25 |
| 2003/0064796 | A1 * | 4/2003 | Glavich et al. | ..... | 463/25 |
| 2004/0097286 | A1 * | 5/2004 | Vancura | ..... | 463/26 |
| 2005/0054435 | A1 * | 3/2005 | Rodgers et al. | ..... | 463/25 |

* cited by examiner

*Primary Examiner* — Arthur O. Hall
*Assistant Examiner* — Steve Rowland
(74) *Attorney, Agent, or Firm* — Marvin Hein

(57) ABSTRACT

Disclosed herein is a new bonus game for use with primary games of chance (reels, poker, keno, bingo, etc.). The bonus game uses a plurality of elements comprising both "good" and "bad" elements. The "bad" elements count towards an end-game condition, and are called end-game elements. The "good" elements do not contribute to ending the bonus game. When enough end-game elements are collected, selected, etc., the bonus game ends.

13 Claims, 6 Drawing Sheets

Game Device
With Multi-Stop-
Indicator Bonus Round

Game Device
With Multi-Stop-
Indicator Bonus Round

Bonus Game Using Two Or More Stop Indicators

Fighting Bonus Game Using Two Or More Stop Indicators

Eating Bonus Game Using Two Or More Stop Indicators

Figure 5

5A

FIGHT BONUS

| | | Average |
|---|---|---|
| A | 10 | 9.00 |
| B | 20 | 20.25 |
| Total = | 30 | |

| | |
|---|---|
| Max. = | 360 |
| Min. = | 15 |
| Avg. Bonus = | 135.96 |

5B

| # of A's | # of B's | Combos | Hits 1 in: | Prob. | Avg. Pays | Contribution |
|---|---|---|---|---|---|---|
| 3 | 0 | 1 | 33.8333 | 2.96% | 27 | 0.79802956 |
| 3 | 1 | 3 | 45.6750 | 6.57% | 47.25 | 3.10344828 |
| 3 | 2 | 6 | 62.5026 | 9.60% | 67.5 | 6.47972717 |
| 3 | 3 | 10 | 86.8092 | 11.52% | 87.75 | 10.1083744 |
| 3 | 4 | 15 | 122.5542 | 12.24% | 108 | 13.2186434 |
| 3 | 5 | 21 | 176.1716 | 11.92% | 128.25 | 15.2876485 |
| 3 | 6 | 28 | 258.3851 | 10.84% | 148.5 | 16.0922616 |
| 3 | 7 | 36 | 387.5776 | 9.29% | 168.75 | 15.6742807 |
| 3 | 8 | 45 | 596.2732 | 7.55% | 189 | 14.2635955 |
| 3 | 9 | 55 | 944.0993 | 5.83% | 209.25 | 12.1901906 |
| 3 | 10 | 66 | 1544.8897 | 4.27% | 229.5 | 9.80458342 |
| 3 | 11 | 78 | 2626.3125 | 2.97% | 249.75 | 7.41743414 |
| 2 | 12 | 78 | 2334.5000 | 3.34% | 261 | 8.72049689 |
| 1 | 12 | 12 | 1235.9118 | 0.97% | 252 | 2.44677661 |
| 0 | 12 | 1 | 686.6176 | 0.15% | 243 | 0.35390876 |
| | | | | 100.00% | | 135.9594 |

5C

| Spoiler (A) pays | Non-Spoiler (B) Pays |
|---|---|
| 5 | 5 |
| 5 | 5 |
| 5 | 5 |
| 5 | 10 |
| 10 | 10 |
| 10 | 10 |
| 10 | 15 |
| 10 | 15 |
| 15 | 15 |
| 15 | 15 |
| ↓ | 15 |
| | 20 |
| | 20 |
| | 20 |
| | 25 |
| | 25 |
| | 25 |
| | 50 |
| | 50 |
| | 50 |

Probability of Drawing :

| | |
|---|---|
| 0.088669951 | 3 times |
| 0.26272578 | 4 times |
| 0.47997979 | 5 times |
| 0.691170898 | 6 times |
| 0.856763926 | 7 times |
| 0.9536155 | 8 times |
| 0.975288579 | 9 times |
| 0.928846266 | 10 times |
| 0.83015635 | 11 times |
| 0.699079032 | 12 times |
| 0.555379453 | 13 times |
| 0.415792104 | 14 times |
| 0.467766117 | 14 times |
| 0.126222603 | 13 times |
| 0.017476976 | 12 times |

Avg. draws before spoiling out: 8.35

Figure 6

6A

Refrigerator Bonus

| | | Average |
|---|---|---|
| A | 6 | 5 |
| B | 6 | 52.50 |
| Total = | 12 | |

| | |
|---|---|
| **Max. =** | **315** |
| **Min. =** | **10** |
| **Avg. Bonus** | **99.45** |

6B

| # of A's | # of B's | Combos | Hits 1 in: | Prob. | Avg. Pays | Contributio |
|---|---|---|---|---|---|---|
| 2 | 0 | 1 | 4.40 | 22.73% | 10 | 2.272727 |
| 2 | 1 | 2 | 7.33 | 27.27% | 62.5 | 17.04545 |
| 2 | 2 | 3 | 13.20 | 22.73% | 115 | 26.13636 |
| 2 | 3 | 4 | 26.40 | 15.15% | 167.5 | 25.37879 |
| 2 | 4 | 5 | 61.60 | 8.12% | 220 | 17.85714 |
| 1 | 5 | 6 | 154.00 | 3.90% | 267.5 | 10.42208 |
| 0 | 6 | 1 | 924.00 | 0.11% | 315 | 0.340909 |
| | | | | 100.00% | | 99.4535 |

6C

| Spoiler (A | Non-Spoiler (B) | Pays |
|---|---|---|
| 5 | 20 | 0.454545455 |
| 5 | 30 | 0.818181818 |
| 5 | 40 | 0.909090909 |
| 5 | 50 | 0.757575758 |
| 5 | 75 | 0.487012987 |
| 5 | 100 | 0.233766234 |
| | | 0.006493506 |

Avg. draws before spoiling out: 3.67

MULTIPLE STOP INDICATOR BONUS GAME

RELATED APPLICATIONS

This application claims the benefit of provisional application 60/616,582 filed on Oct. 5, 2004. Provisional application 60/616,582 is hereby incorporated in this application, in full, by explicit reference.

BACKGROUND OF THE INVENTION

1. Field of the Invention

This invention pertains generally to gaming systems. More particularly, the present invention discloses a bonus game in which a player keeps playing until they collect a plurality of termination symbols or stop indicators.

2. The Prior Art

Gaming machines having a primary game whose outcome is based at least partially on a random event use various bonus schemes to increase player interest. One type of bonus game or bonus round is an additional random event which requires no player participation, and usually multiplies the player's amount won in a primary game by some amount. Another type allows a player to pick from several choices; with each pick, the player either wins addition credits or hits a "stop condition"—a choice that stops the bonus round. One example of this type of bonus round is IGT®'s Little Green Men® reel game. Upon entering a bonus round, a screen is displayed with space ships in the sky. A player selects space ships; under each is a point value or terminator symbol. The player wins the points value under each space ship they pick until they select a ship which has a stop (termination) symbol underneath it. The bonus game ends upon selection of a single stop indicator.

There is room for improvement in bonus rounds having selections.

BRIEF DESCRIPTION

Disclosed is a new bonus game system for use with primary games of chance (reels, keno, bingo, poker, etc.). A primary component of the bonus game or bonus round of game play is the novel use of a plurality of end-game elements, or indicators. The use of multiple end-game elements in a single bonus game allows new and unique variability in bonus game play. The bonus game ends when a predefined plurality of end-game elements are used or selected during a single bonus game play sequence. A bonus game sequence may be relatively simple or extremely complex. One basic embodiment includes generating a set of bonus game elements on a screen and allowing players to continually select elements until they have accumulated a predefined number of the end-game elements (at least two, up to a predefined number). The player is then awarded the number of bonus points from the elements selected to that point. This add interest to the player, as the can see how close they are to losing the game as they accumulate end-game elements. In a variation of the basic game, the number of end-game elements can be changed at the start of each bonus game. The number of end-game elements could change based on a random event, bounded within a predetermined range (for example, a random choice of 2-4 end-game elements for a basic bonus game). The number of end-game elements could be increased by using a player's promotion points or credits from a player tracking account. In the later case, a player is using promotional awards or points to increase their chances of further winnings in a bonus game.

A more complex bonus game would involve several rounds of sub-game play. In each sub-game or level, the game uses some number of bonus game elements. This includes a number of end-game elements. Play of the sub-game or level ends when the player either: reaches ("achieves" or wins) a certain number of bonus points or other predetermined win event for this level; has used a specified number of game elements (total of end-game elements and regular elements); or, has accumulated a specified number of end-game elements. Each game designer and mathematician will select which type of game play to use depending on their selected model; all are within the scope of the present disclosure. After each level is completed, the next level is started. This continues until the player has accumulated an over-all number of end-game elements; loses at any one level; loses at a predetermined number of levels; has used some number of both end-game and regular elements; or, wins a certain number of levels.

The novel bonus game concept is disclosed in general and in two specific embodiments below. The two specific embodiments illustrate how differently games using the new multi-stop bonus system can appear to a player, even though both are enabled by the use of the new concepts disclosed herein.

BRIEF DESCRIPTION OF THE DRAWINGS

FIGS. 5 & 6 are example paytables usable with the bonus game in accordance with the present disclosure.

DETAILED DESCRIPTION

Figure 1:
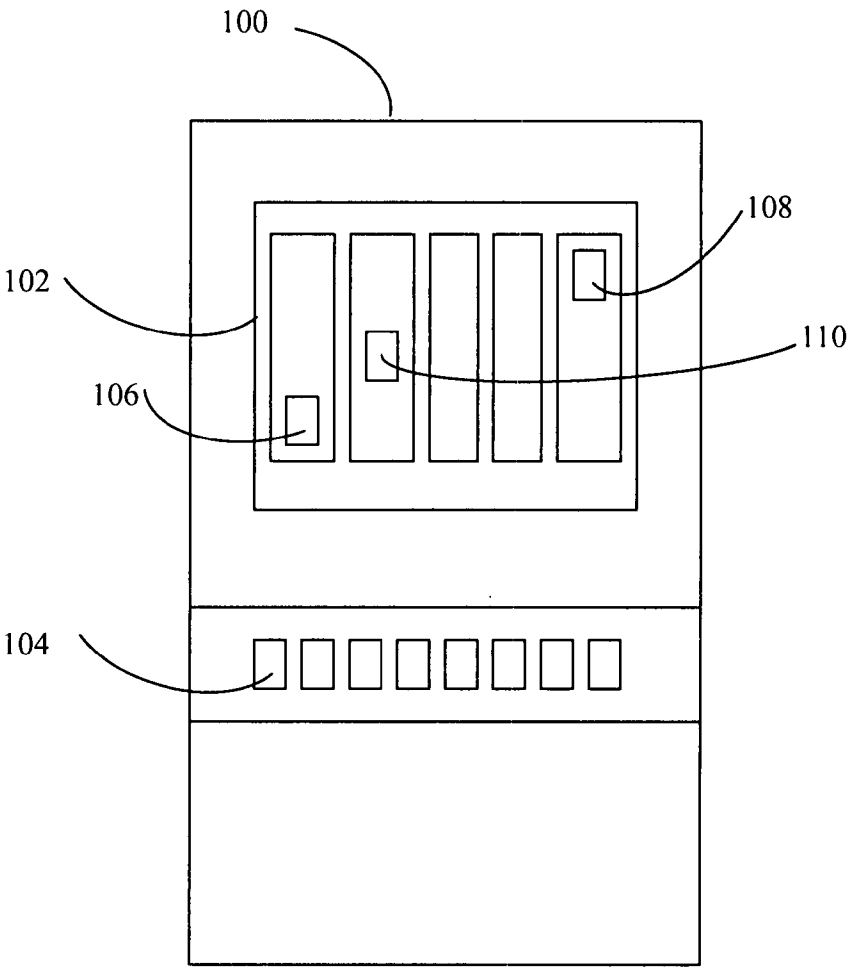
FIG. 1 is a functional block diagram of an example game device in accordance with the present invention.

Persons of ordinary skill in the art will realize that the following description of the present invention is illustrative rather than limiting. Other embodiments of the invention will readily suggest themselves to such skilled persons having the benefit of the present disclosure.

Referring to the drawings, for illustrative purposes the present invention is shown embodied in FIGS. 1 through 6. It will be appreciated that the apparatus may vary as to configuration and as to details, and that the method may vary as to details, partitioning, inclusion or exclusion of some portions, and the order of any described acts without departing from the inventive concepts disclosed herein.

FIG. 1 shows a game device according to the present invention. The game device has a cabinet 100 enclosing a video display 102 and a set of standard game play buttons, shown generally as buttons 104. The game device also comprises the internal hardware and software needed for gaming devices, including at least one programmable processor, dynamic memory, non-volatile memory, system support circuitry enabling a commercial embedded operating system such as QNX® and gaming applications to run, and I/O connections including interfaces to various player input and output devices such as play buttons 104, and an interface to an external network. Also included is the software needed to implement specific games described herein. The internals are not illustrated.

The software in gaming machine 100 will have a new and unique bonus round. The main game will have its normal paytable and theme. It will also have at least one win event that will enable a player to enter a bonus round. Shown in FIG. 1 is an exemplar event that triggers a bonus round. Three specially designated symbols 106, 110, and 108 occur in a scatter pay pattern, thus triggering a bonus round. Any bonus triggering method may be used.

Figure 2:
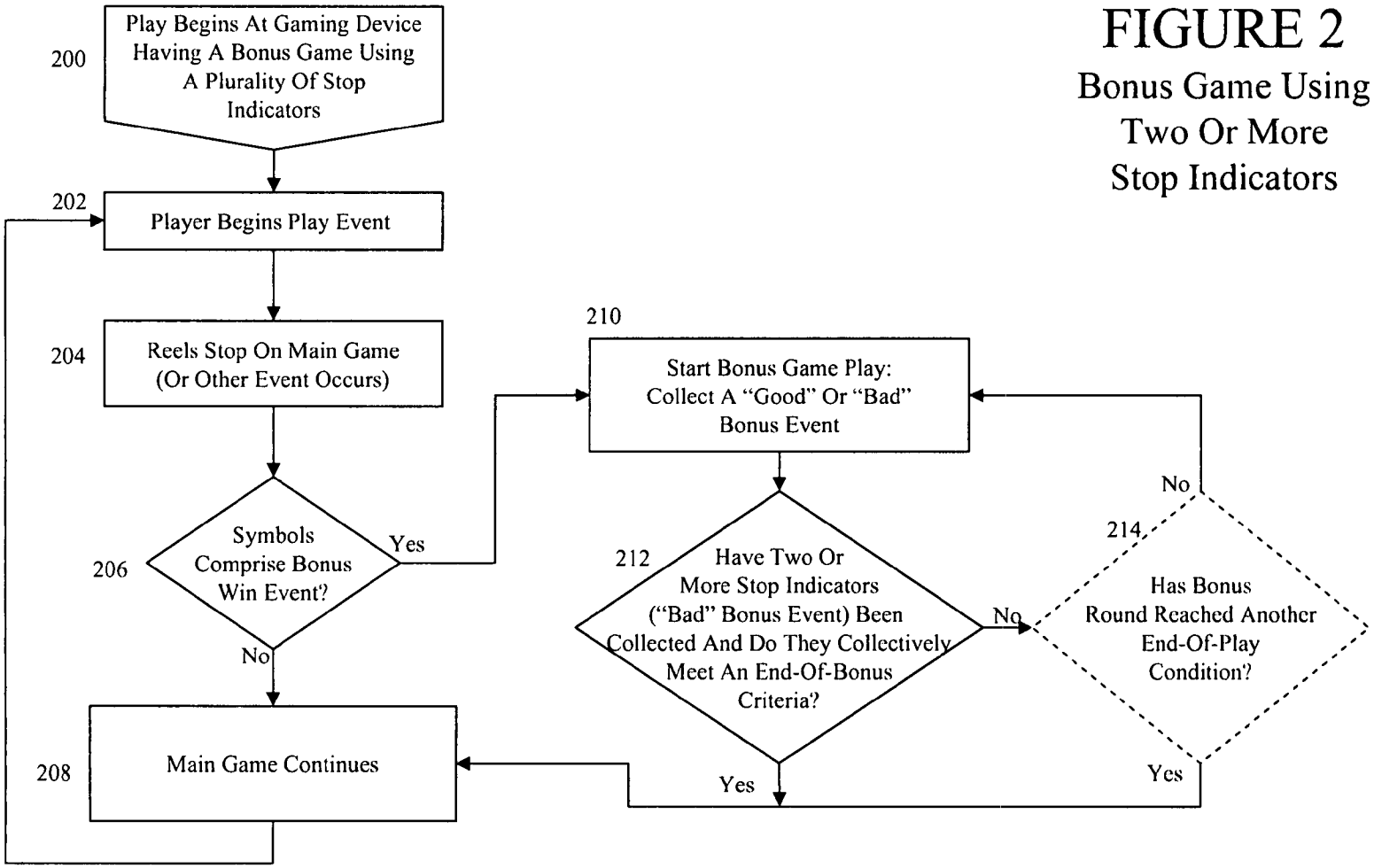
FIG. 2 is a flow diagram illustrating multiple stop indicator bonus game play in accordance with the present invention.

FIG. 2 illustrates general principles of the new bonus game disclosed herein. Box 200 comprises those actions associating with a player choosing to play a game having a bonus game in accordance with the present invention. Continuing into box 202, the player begins play at the main game level, setting the main reels in motion. Box 204 corresponds to the main game playing until the reels stop (note: a reel game is being used as an exemplar game of chance: any game leading to a bonus round where the outcome of the main game is based at least partially on random events is usable with the present invention). After the main reels stop, diamond 206 corresponds to the actions needed to determine if the symbols found in the viewable area (102 of FIG. 1) comprise a bonus game trigger. If the answer is "No", diamond 206 is left for box 208. The actions corresponding to box 208 are any needed to finish this game (for example there may be other bonus win events that need finishing). After this game is completed, box 208 is left for box 202, where a next main game is initiated.

Returning to diamond 206, if the answer is "Yes" then box 210 is entered. The actions corresponding to box 210 include those needed to select a predetermined number of bonus elements from a pool of bonus elements, usable with the particular bonus game. There are many ways to select bonus elements; discussed below are bonus element selection techniques that are currently expected to be the most popular embodiments.

One embodiment will select all the bonus game elements needed to complete an entire bonus game before bonus game play starts. Another embodiment will select bonus game elements from a pool of elements as needed; each time as player makes a selection of a visible element on a screen the game logic will select as pool element and display the result. Still another embodiment will select the "stop" elements (the ones that are tallied up until game play ends) upon invocation of the bonus game, and generate "win" elements dynamically as game play progresses. These and other methods of selecting elements from a pool or virtual set of elements are all entirely compatible with the novel bonus game disclosed herein.

The player selectable elements that make up the bonus game are grouped into elements called "bad" and "good" elements. "Bad" elements are those that are used to determine when the bonus game is to end. "Good" elements are any bonus game elements that are not used in determined when the bonus game shall send. Good elements will usually have a positive credit or value associated with them, but good elements may have 0 value. It would also be possible to design a bonus game where good elements can have negative values (a player loses some number of bonus credits from their total), but that is not currently thought to be a preferred embodiment.

Bad elements are totaled until the game ending criteria are met. One embodiment will simply count the number of bad or stop elements until a predetermined threshold number is reached. It is expected that one preferred embodiment will accumulate either 2, 3 or 4 stop elements to end the bonus round. Another embodiment will total the value of the bad elements until a predetermined "bad value" number is reached. In each case, the bad elements are used to calculate a value that will eventually end the bonus round.

In yet another embodiment, both good and bad elements have bonus credit values attached. Each time a player picks a game element they win the value associated with that game element. If the element is a bad element, the number of bad elements selected is incremented by one in addition to awarding the player the bonus credit value of the element. Game play continues until the player accumulates the needed number of bad elements.

The pool of bonus game elements may be used in any way that suits the needs of the game designers and mathematicians. It is expected that most embodiments will use one of the following three pool use methods.

1. Elements are selected from the pool and are no longer available for the remainder of this bonus round; the pool is being depleted as elements are picked. Pool elements include both "good" and "bad" elements as previously described. Each element will have a positive bonus credit value, and the game ends when a predetermined number of bad elements are selected.
2. Elements are selected from the pool as the game is played. The bonus game comprises "rounds" or discernable subgames; at the end of each subgame the bad elements are removed from the players accumulated bad element list and re-entered into the pool. Over time, this increases the likelihood of a bad element being selected while giving the player the appearance of "starting over" for the next subgame.
3. All pool elements are available for each element selection event. This corresponds to the player not carrying forward accumulated "bad" elements from one round in a bonus game to the next, and keeps the probability of selecting a specific element the same during game play.

The use of pool elements as described above does not have to change the amount a player has won. For example, if pool method 3 is being used, and during the first round of a bonus game the player wins X credits, those X credits stay with the player even though the conceptual model of element usage is to "return" elements to the pool.

A currently preferred embodiment has a pool comprised of a plurality of "good" and "bad" elements, with each element also having a positive integer value. Elements will not be reused during the draws that comprises a single bonus game, described as choice 1 above. Elements are randomly selected until the needed plurality of stop elements are selected to end the bonus round, or, the bonus round ends because the player has reached an alternate ending criteria for this bonus round play. A player wins the value of each element (i) selected during bonus round game play, or (ii) otherwise shown to a player by the game logic for each round of the bonus game play. This includes both "good" and "bad" elements. In this embodiment each element has at least two independent properties used by the game: its "good" or "bad" value (a binary value), and its point value (a positive integer).

Returning to FIG. 2, the actions corresponding to box 210 include those that occur after at least one of these elements has been chosen and the player makes a selection in the bonus round that reveals the element, good or bad. Continuing into diamond 212, a determination is made of the player's "bad" state. If the "bad" state value meets a certain threshold the bonus game ends. In general this is expected to be 2, 3, or 4 selected stop indicators (bad elements). Game designers will make a choice of how many stop indicators will end a bonus game. Further, it may be made programmed to be variable depending on the current state of the play and the player (players using a player tracking card can be awarded more stop indicators per bonus round as a reward). If the threshold number of stop conditions has been met, then the bonus game ends with the "Yes" exit is taken to box 208, where the player is credited with their winnings from the bonus round and the main game continues. If the answer is no, the "No" exit is taken to diamond 214. Diamond 214 is dotted to indicate it is optional, although it is a preferred embodiment. The game may return to box 210 directly.

Continuing with diamond 214, a determination is made to see if the bonus game has reached an end-of-play state different than a termination state caused by a plurality of stop elements. Because the picking of good and bad elements from the bonus pool is probabilistic in nature, there is a probability that a bonus game could go on for a longer time than is desirable for casino game play. To contain the time spent in a bonus game, one embodiment will have two ways the bonus round can end. One termination condition is the occurrence of 2, 3, or n number of bonus terminators. The second termination condition ends the bonus round regardless of the state of a player's stop conditions. The presently preferred embodiment for the second termination condition is simply the overall total number of elements (good and bad) a player has selected or used in the current bonus game. One embodiment ends the bonus game upon the first occurrence of either: two bad elements; or, a game total selection of eight elements (good and bad).

Although expressed in terms of adding game-ending ("bad") elements until a certain number in reached, any method of keeping track may be used. Another embodiment will have a starting number (say, 10), and each time a game-ending element is selected the number is decremented. The game ends when the count turns to zero or becomes negative. The number may be decremented by a single count each time in which case the number always becomes 0; or, the number may be decremented by the value of the bad element. In the later, case, the count could turn negative.

The second end-of-game condition can be anything the game designer wishes to use as a metric. The presently preferred second end-of-game condition is based on a maximum number of pool elements usable in a game. If a player reaches the end-of-game condition, a preferred embodiment is to award a player an extra amount of credits or other prize for reaching the end-of-game.

A further embodiment does not make use of an explicit second termination condition. Instead, the pool contains the maximum number of elements usable in a single game. Since the pool contains both good and bad elements, and the number of bad elements in the pool must be at least the number required to terminate the bonus round, the game must end when the pool elements are all selected. One example is a pool of eight elements with three bad elements, where the game ends upon the selection of the third bad element. The game will always end with a maximum of eight element selections.

Returning to diamond 214, if the player has reached a second end-of-game condition then diamond 214 is left for box 208, where the player is awarded any credits not already awarded for this round and main game play continues. If the answer is "No", the bonus round is still continuing and box 210 is re-entered, where the next game event using an element from the pool is carried out.

Figure 3:
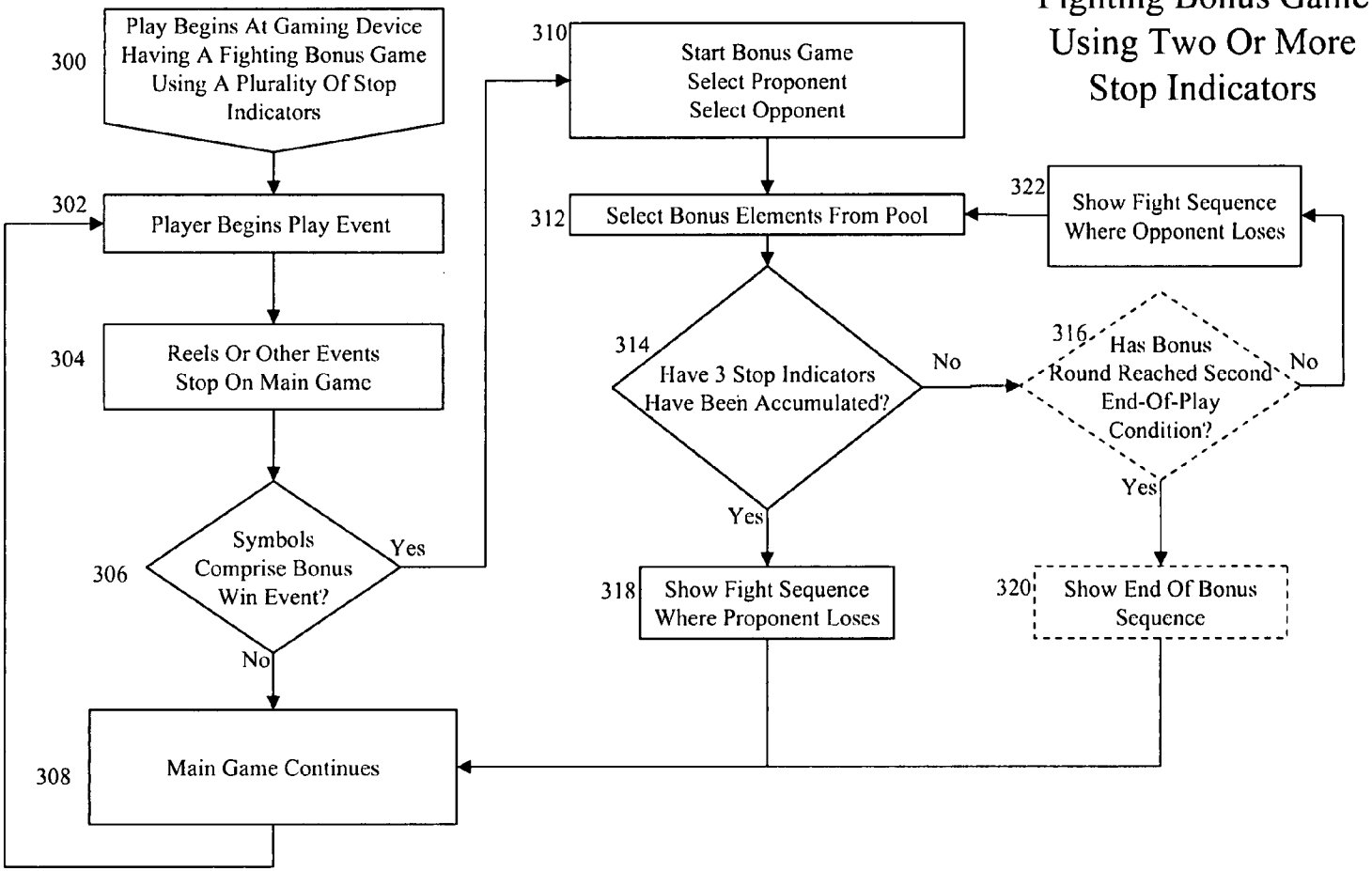
FIG. 3 is a flow diagram illustrating a fight bonus game using multiple stop indicators in accordance with the present invention.

FIG. 3 illustrates one type bonus game that makes use of the plurality of stop conditions of the present invention. FIG. 5 shows the mathematical basis for implementing this particular game. The bonus game is called "Super Seniors"™ and is a fight game. The player selects a "champion" (currently implemented as either an old male hero or an old female heroine, thus the name "Super Seniors"™; any fighter representations may be used), and then selects one of four opponents the champion will fight. For each pick of one opponent, the game could end if the elements drawn include 3 bad elements. In this implementation, the good elements count against the opponent. Both types of elements add to the amount of credits the player will win (a future implementation may only have credits associated with the good elements). The game logic picks enough elements from the pool of good and bad elements such that either the player or the opponent is eliminated. In this particular implementation the player's bonus game ends if 3 bad elements are accumulated as the player proceeds through all four phases of the game (all four fights). It is represented as a "life meter" on the front of the game, where the life meter goes down in a graphical manner for each bad element until the player dies (looses). The opponents are considered beaten (they are graphically shown in jail in the present bonus game) when enough good elements are selected from the pool for each fight. At the start of each battle the game logic selects elements from the pool until the first occurrence of: enough bad elements (stop conditions) are selected to kill for the player; or, enough good elements are selected to beat the opponent. The screen then shows a battle corresponding to the elements just selected. The player continues until they die (accumulate 3 stop conditions) or all four villains have been beaten.

Box 300 corresponds to the actions that result in a player selecting a fight themed bonus game, the game implemented in accordance with the present invention. Box 302 corresponds to a player starting game play on the main game. The main game can be any game whose outcome is based at least partially on a random event. Box 304 corresponds to the main game coming to completion in the sense of determining if the bonus game will be entered. Although this will typically be a reel game, it could be a poker game, bingo game, keno game, etc. Diamond 306 is then entered, where a determination is made if a bonus game has been triggered. If no bonus game has been triggered, diamond 306 is left for box 308 where any remaining game activity for this game play concludes (there may be none, or there may be other bonuses or events to finish, etc.). Box 308 is then left for box 302, where main game play continues.

If, in diamond 306, it is determined a bonus event has occurred, then diamond 306 is left for box 310. The actions corresponding to box include the player selecting a proponent and an initial opponent for the start of the fight bonus rounds. This is particular to a specific implementation. Variations include but are not limited to: having only one proponent; having a different number of opponents than four; having a single opponent who collects points against her/himself just as the proponent is collecting bad points; etc. Other variations of the fight bonus round will come the mind of a person skilled in this art and having the benefit of the present disclosure. All variations are within the inventive scope disclosed herein.

After picking a proponent and a first opponent, box 310 is left for box 312. Actions that correspond to this box include selecting the bonus elements applicable to this stage of the bonus game. The game logic will select, from the bonus element pool, a set of elements such that one of the following is true: a first occurrence of enough bad elements so the proponent is eliminated; or, a first occurrence of enough good elements so that the opponent is eliminated.

Continuing into diamond 314, a determination is made as to the total number of stop conditions the proponent now has. It will be appreciated that this calculation was actually carried out at the same time the selections were made in box 312, as the current implementation of the fight bonus game requires that the choosing of elements from the pool stop as soon as the either the opponent or proponent will lose; as is often the case when flow-charting explanatory sequences, they need to be different than the implementation sequences.

If the proponent has collected 3 stop conditions, the "Yes" exit is taken to box 318. The actions corresponding to box 318 are those showing an animated sequence where the proponent is beaten by the opponent. Any credit not yet awarded to the player are put on the credit meter, and box 318 is left for box 308, where main game play continues.

If the proponent has not collected 3 stop conditions, then diamond 314 is left for diamond 316. Diamond 316 and box 320 are used only when a secondary game play stop condition is used. The actions corresponding to diamond 314 are those needed to determine if the second end-of-game condition has been met. In one implementation of the fight game, the end condition is the proponent winning against four opponents. If the proponent has won four other draws (against four opponents), the end condition is met and the "Yes" exit taken to box 320. The player is shown various end-game graphics and is awarded a final predetermined number of credits for having won over four opponents. Box 320 is left and box 308 re-entered, where main game play continues.

If the end of game condition is not met, the "No" exit is taken from diamond 316 into box 322. The actions corresponding to box 322 include showing the player a set of graphics that correspond to the opponent being beaten by the proponent (captured, killed, etc., as fits the specific motif of the particular fight game). Box 322 is then left and box 312 re-entered, where the next set of elements are selected from the element pool and the bonus round continues.

FIG. 5 shows an exemplar math model usable with the game described in FIG. 3. FIG. 5A illustrates the overall range and average expected values for the bonus round. A's represent a stop indicator or stop event, and B's represent a win event.

FIG. 5B shows probabilities of combinations of A's and B's. The A and B column is the number of A's and B's in a game sequence (3 A's, which is 3 stop indicators, ends the bonus round). The rest of the columns are as follows:

Combos is the number of combinations that can result in the corresponding number of A's and B's. This value is determined by [(B+(A−1))!]/[B!*(A−1)!]

Hits 1 in shows the number of times the combination hits in how many rounds. This value is determined by (Total A+B)!/[(Total A+B)−(#A's+#B's)]!*[(Total B's−#B's)!/(Total B's)!]*[(Total A's−#A's)!/(Total A's)!]

Prob. is the probability of ending the game with the given combination. This value is determined by (Combos/Hits 1 in).

Avg. Pays shows the expected value for each amount of successful choice. This is NOT the expected average value of the bonus round: rather, what it shows is if the player does reach "X" successful choices, the expected value for those "X" choices will be that number. This value is determined by: (Avg. A Value*# of A's)+(Avg. B Value*# of B's).

Contribution shows the contribution of each pay to the total bonus game. This value is determined by: (Avg. Pays)* (Prob).

FIG. 5C shows different combinations of payout values, and a table showing the probabilities associated with the number of draws made per bonus round.

In one preferred embodiment, all pays are multiplied by the total bet on the initiating line.

Figure 4:
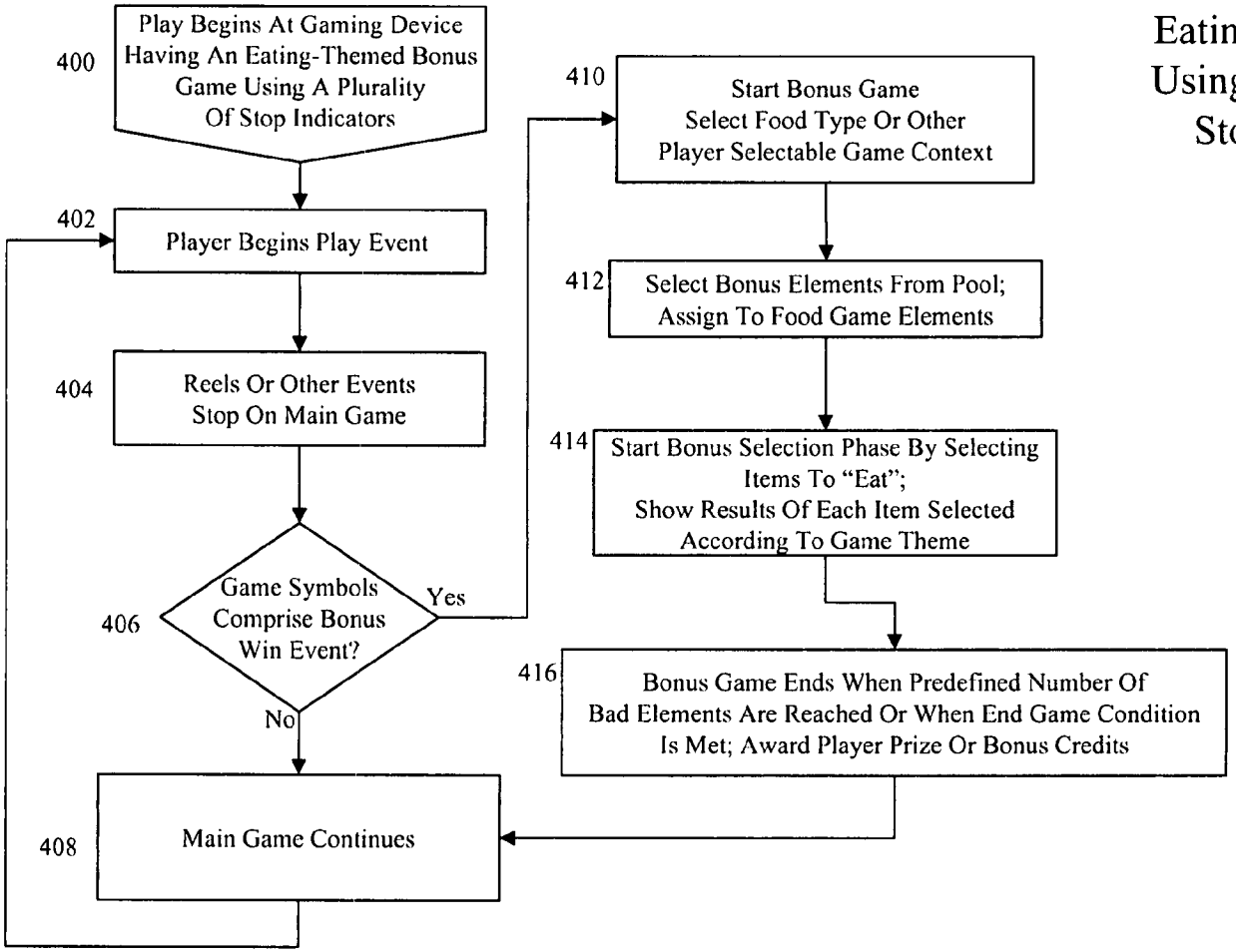
FIG. 4 is a flow diagram illustrating an eating bonus game using multiple stop indicators in accordance with the present invention.

FIGS. 4 and 6 show details of a food-based bonus game using the multiple stop conditions of the present invention. A game called "Midnight Snack"™ has been developed where, upon starting the bonus round, a set of six elements from the pool of bonus elements is selected. Each of six food items is pictured inside of a refrigerator and is assigned one of the selected elements (good-element/bad-element and a point value). This bonus game is simpler than the fight bonus game, and will play faster. An animated figure is shown opening a fridge door, and the player then selects (using a touchscreen) food items, one at a time. Upon selecting a food item, a point value is shown and awarded to the player. The "good/bad" is also shown (note: the player gets the bonus point value associated with each element they select, regardless if the other element attribute is "good" or "bad"). In this game, a player keeps selecting food items until they select a total of two stop conditions (bad elements) or until they have selected all six. Various animations are shown, such as the bad food items chasing the midnight snacker in his sleep, for entertainment. In this game, the end-of-game condition is the use of six elements.

Box 400 corresponds to a player selecting a game having a food-based bonus game according to the present invention. Continuing into box 402, the player starts main game play. Continuing into box 404, the main game comes to a stopping point. As with FIG. 3, the main game can be any game whose outcome is at least partially determined by chance. Continuing into diamond 406, a determination is made as to eligibility to enter into a bonus round in accordance with the main game's paytables. If the answer is "No", diamond 406 is left and box 408 entered, where any remaining actions needed to complete the current main game are taken (there may or may not be any). Box 408 is left and box 402 re-entered, where main game play continues.

If the determination at diamond 406 is that a bonus game has been triggered, then the "Yes" exit is taken to box 410. The actions corresponding to box 410 include initializing the bonus game, with the player making any optional selections such as food type, eating place, etc. In "Midnight Snack"™ these selections are already made for the player, and the bonus game can be initialized. Continuing into box 412, the game logic selects the same number of bonus game elements as there are food items in the bonus round. Each selected bonus game element is then assigned to a food item seen by the player.

Continuing into box 414, the actions taken include the player making a sequence of food item selections. After each selection, the results are shown to the player. The results always include an award value or credit value associated with the food item, which the player gets no matter if the food is "good" or "bad". Alternative embodiments could give non-positive values to the "bad" elements.

Continuing into box 416, the player keeps selecting food items until a total of 2 bad items are selected or the player has selected all six food items (the second end-of-game condition), whichever occurs first. The player gets the points they collected, and is then shown funny animations the correspond to the food selected. In the case of good food, a happy night's sleep. If two bad items are selected, the animation shows the midnight snacker going to bed and, in his dreams, being chased by the food items that had a bad element associated with them. Box 416 is left and box 408 re-entered, where the main game play is continued.

FIG. 6 shows an exemplar math model usable with the game described in FIG. 4. FIG. 6A illustrates the overall range and average expected values for the bonus round. A's represent a stop indicator or stop event, and B's represent a win event.

FIG. 6B shows probabilities of combinations of A's and B's. The A and B column is the number of A's and B's in a game sequence (2 A's, which is 2 stop indicators, ends the bonus round). The rest of the columns are as follows:

Combos is the number of combinations that can result in the corresponding number of A's and B's. This value is determined by [(B+(A−1))!]/[B!*(A−1)!]

Hits 1 in shows the number of times the combination hits in how many rounds. This value is determined by (Total A+B)!/[(Total A+B)−(#A's+#B's)]!*[(Total B's−#B's)!/(Total B's)!]*[(Total A's−#A's)!/(Total A's)!]

Prob. is the probability of ending the game with the given combination. This value is determined by (Combos/Hits 1 in).

Avg. Pays shows the expected value for each amount of successful choice. This is NOT the expected average value of the bonus round; rather, what it shows is if the player does reach "X" successful choices, the expected value for those "X" choices will be that number. This value is determined by: (Avg. A Value*# of A's)+(Avg. B Value*# of B's).

Contribution shows the contribution of each pay to the total bonus game. This value is determined by: (Avg. Pays)*(Prob).

FIG. 6C shows a table of payout values, and the probabilities associated with that combination of draws made per bonus round.

In one preferred embodiment, all pays are multiplied by the total bet on the initiating line.

Although the description above contains certain specificity, the described embodiments should not be construed to indicate the scope of the invention; the descriptions given are providing an illustration of certain preferred embodiments of the invention. The scope of this invention is determined by the appended claims and their legal equivalents.

The invention claimed is:

1. A method for operating a game including the steps of:

initiating a primary game whose outcome is based at least partially on a random event;

triggering a bonus game when a pre-selected event occurs in said primary game;

selecting a subset of a plurality of bonus game elements, said bonus game elements comprising a plurality of end-game elements and non-end-game elements;

enabling player selection of a series of the subset bonus game elements; and ending said bonus game upon player selection of a predetermined number of end-game elements, said predetermined number being a plurality.

2. The method of claim 1 where said ending further comprises ending upon a first occurrence of either said predetermined number of end-game elements or upon a second stop-game event.

3. The method of claim 2 where said second stop-game event comprises player selection of a predetermined maximum number of elements.

4. The method of claim 1 where said subset selecting step includes variably determining the number of bonus game elements.

5. The method of claim 1 including the step of associating an award with one or more of the player selected elements.

6. A method for operating a bonus game, the bonus game being entered upon an occurrence of a bonus game event in a primary game, the primary game being a game whose outcome is based at least partly on chance, the method including the steps of:

a) enabling a player to select a bonus game element from a set of bonus game elements;

if a selected bonus game element is an end-game element, incrementing an end-game element count;

d) if the selected element has an associated value, incrementing a value count accordingly;

e) repeating steps (a)-(d) until the end-game element count reaches a pre-selected number, said number being at least two.

7. The method of claim 6 including the step of increasing the pre-selected number based on a player associated value.

8. The method of claim 6 the repeating step occurring until a first occurrence of the end-game element, or, a predetermined plurality of bonus game elements being selected.

9. The method of claim 6, the enabling step including providing the set of bonus game elements from a pool of elements having a plurality of end-game elements therein.

10. A gaming machine comprising:

gaming machine logic operably disposed in said gaming machine providing;

a display in operable communication with said game machine logic;

said gaming machine logic configured to allow play of a primary game and a bonus game, said primary game's outcome based at least partly on chance, said primary game including a bonus triggering outcome to initiate the bonus game;

said bonus game comprising a set of player selectable bonus game elements, said elements further comprising a subset of elements that are designated as game-end elements where no single end-game element can end said bonus game, such that the selection of a predetermined plurality of end-game elements by the player terminates said bonus game.

11. The gaming machine of claim 10 the bonus game including a first bonus game level and a second bonus game level; the first bonus game level including a second bonus game level triggering event, one or more of the player selectable bonus game elements having respectively associated bonus values; the associated bonus values being accumulated through the gaming machine logic in accordance with the player selection of various of the bonus game elements; the second bonus game level triggering event comprising a predetermined accumulated bonus value amount.

12. The gaming machine of claim 10 where the bonus game is further configured to terminate if a second stop-game event occurs after a predetermined plurality of bonus game elements has been selected including at least one end-game element.

13. The gaming machine of claim 10 where said set of player selectable bonus game elements are determined by the gaming machine logic from a pool of elements having a plurality of end-game elements therein.

* * * * *